US008499959B2

(12) United States Patent
Chasid et al.

(10) Patent No.: US 8,499,959 B2
(45) Date of Patent: Aug. 6, 2013

(54) PACKET WITH A CLOSURE FOR ITS OUTLET, E.G. FOR ARTICLES STORAGE AND DISPENSING

(75) Inventors: Shlomit Chasid, Mazkeret Batya (IL); Uri Zaidman, Kadima (IL)

(73) Assignee: Tadbik Ltd., Petah Tikva (IL)

( * ) Notice: Subject to any disclaimer, the term of this patent is extended or adjusted under 35 U.S.C. 154(b) by 162 days.

(21) Appl. No.: 13/061,819

(22) PCT Filed: Sep. 3, 2009

(86) PCT No.: PCT/IL2009/000858

§ 371 (c)(1), (2), (4) Date: Mar. 2, 2011

(87) PCT Pub. No.: WO2010/026584

PCT Pub. Date: Mar. 11, 2010

(65) Prior Publication Data

US 2011/0163097 A1 Jul. 7, 2011

Related U.S. Application Data

(60) Provisional application No. 61/136,426, filed on Sep. 4, 2008.

(51) Int. Cl.

| | |
|---|---|
| ***B65D 17/34*** | (2006.01) |
| ***B65D 51/18*** | (2006.01) |
| ***B65D 73/00*** | (2006.01) |
| ***B65D 65/26*** | (2006.01) |

(52) U.S. Cl.

USPC ..... 220/270; 220/254.1; 220/254.3; 220/254.6; 206/233; 206/494; 383/66; 383/203; 383/207

(58) Field of Classification Search

USPC ..... 220/234, 254.1, 254.3–254.4, 254.6, 220/262, 266, 270; 383/42, 66, 200, 203, 383/207–208, 210, 211, 906; 206/233, 494; 221/45, 61–62, 151, 154

See application file for complete search history.

(56) References Cited

U.S. PATENT DOCUMENTS 4,192,420 A * 3/1980 Worrell et al. ..... 206/205
4,552,269 A * 11/1985 Chang ..... 383/211

(Continued)

FOREIGN PATENT DOCUMENTS

DE 203 04 113 U1 5/2003
EP 1 564 154 A1 8/2005
EP 1 780 145 A1 5/2007

(Continued)

OTHER PUBLICATIONS

The Notification of Transmittal of the International Search Report and the Written Opinion of the International Search Authority, or the Declaration, mailed Mar. 30, 2010, along with the International Search Report and Written Opinion; 16 pages total.

*Primary Examiner* — Mickey Yu
*Assistant Examiner* — Brijesh V Patel
(74) *Attorney, Agent, or Firm* — Vorys, Sater, Seymour and Pease LLP; Susanne M. Hopkins; William L. Klima

(57) ABSTRACT

A packet including a closure having a base portion and a flap portion which is at least in use pivotable with respect to the base portion about a pivoting axis; and a face with a flap area corresponding to the flap portion.

14 Claims, 17 Drawing Sheets

U.S. PATENT DOCUMENTS

| | | | | |
|---|---|---|---|---|
| 4,679,693 | A * | 7/1987 | Forman | 383/203 |
| 6,309,105 | B1 | 10/2001 | Palumbo | |
| 6,554,134 | B1 * | 4/2003 | Guibert | 206/494 |
| 6,767,604 | B2 * | 7/2004 | Muir et al. | 428/40.1 |
| 6,889,483 | B2 * | 5/2005 | Compton et al. | 53/412 |
| 7,475,781 | B2 * | 1/2009 | Kobayashi et al. | 206/494 |
| 7,565,976 | B2 * | 7/2009 | Nakamura et al. | 206/494 |
| 7,992,744 | B2 * | 8/2011 | Szymonski et al. | 221/37 |
| 2006/0151515 | A1 * | 7/2006 | Hood et al. | 221/29 |

FOREIGN PATENT DOCUMENTS

| | | | |
|---|---|---|---|
| GB | 2 399 331 | B | 2/2005 |
| JP | 2006-131263 | A | 5/2006 |

* cited by examiner

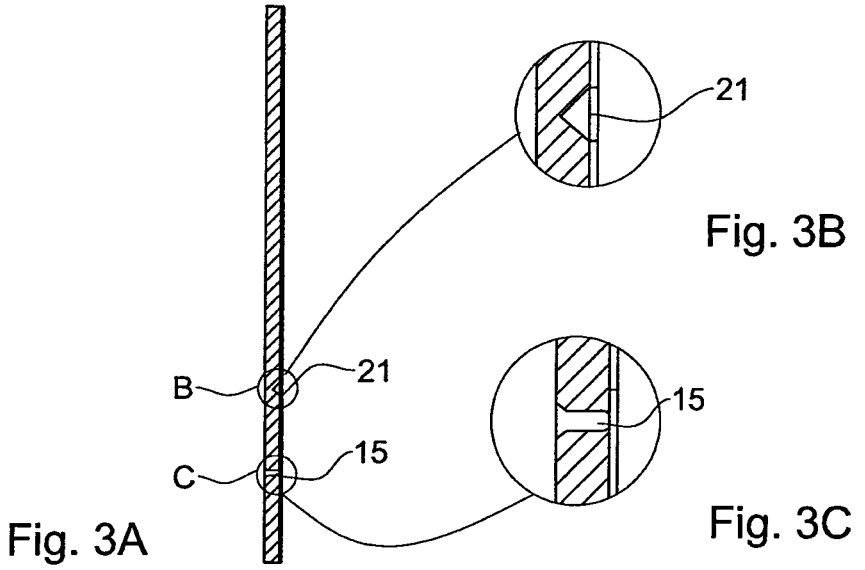
Fig. 3A
Fig. 3B
Fig. 3C
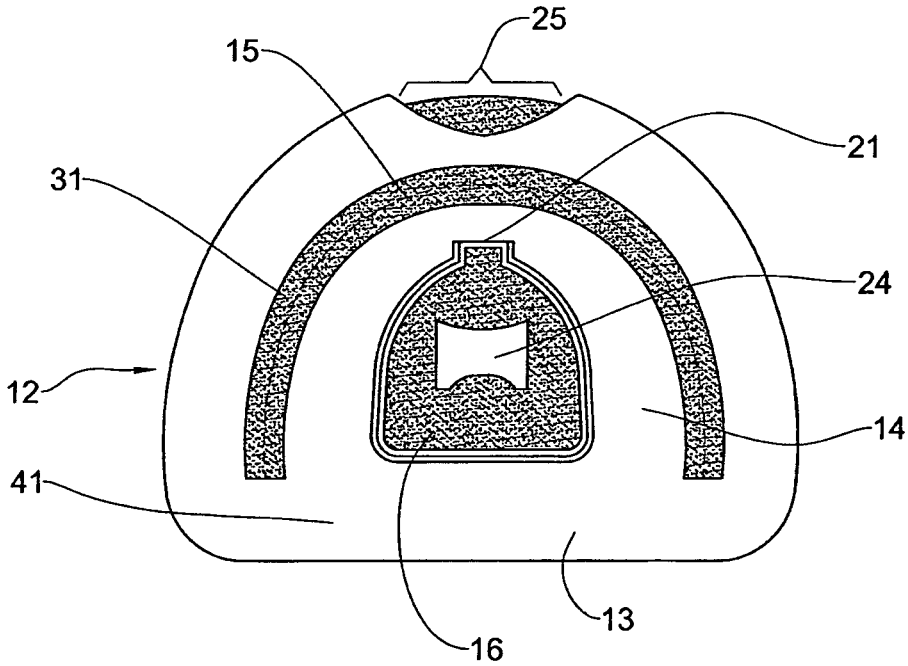
Fig. 4

PACKET WITH A CLOSURE FOR ITS OUTLET, E.G. FOR ARTICLES STORAGE AND DISPENSING

This is a National Phase Application filed under 35 U.S.C. 371 as a national stage of PCT/IL2009/000858, filed on Sep. 3, 2009, an application claiming the benefit under 35 USC 119(e) of U.S. Provisional Application No. 61/136,426, filed on Sep. 4, 2008, the content of each of which is hereby incorporated by reference in its entirety.

FIELD OF THE SUBJECT MATTER

This subject matter relates to a dispensing packet with a face and a closure at the face of the packet for the outlet at the face of such a packet. This packet may contain and dispense articles such as wet or dry tissues or the like, a variety of dry and wet foodstuffs etc. and may be stored at home or be easily carried on one's person, in a diaper bag, in the glove compartment of a vehicle etc.

BACKGROUND OF THE SUBJECT MATTER

Packets for articles such as tissues are well known in the art. These articles may be stored in either a wet (soaked in a cleaning agent, skin treatment etc.) or dry state. Typically these packets are in the form of a soft packet or rigid container depending on its portability requirements. Soft packets for wet tissues are usually made of a flexible, airtight film while rigid containers are generally made of molded plastic or cardboard.

The tissues are typically rectangular in shape and can be supplied as separately connected sheets or interleaved discrete sheets, stacked to ensure that as the leading tissue is removed from the package a portion of the trailing tissue passes through the outlet and releases the leading tissue once in a position to allow its (the trailing tissue's) easy removal when required (and in turn becoming the leading tissue). Tissues may also be stacked simply without interleaving so the removal of the top tissue has no bearing on the positioning of those below.

The outlet of packets may take a number of forms. A typical form is a narrow aperture through which the tissues are pulled one at a time as required. This shape facilitates the sequential dispensing of interleaved tissues; however it is also often a requirement that such outlets need to be repeatedly resealed. The capability to reseal the packet minimizes exposure of the articles therein to the ambient environment thus preventing foreign matter from entering the packet and maintaining moisture within the packet (where wet tissues are the article) when the packet is not in use. A well designed closure should, among other things, minimize contamination and moisture loss through the outlet.

Closures for packets already exist in a number of forms including a hard plastic frame around the outlet with a hard plastic flap hinged on the frame, able to be opened and clipped closed as required. Another current design is a soft plastic flap detachably attached to the packet which peels open to expose the outlet and may be reattached over the outlet with an adhesive layer on the flap. These designs require the complete detachment of a section of the packet to create an outlet.

Resealable packets for dried fruit etc. also exist on the market, generally utilizing resealable zipper storage bags.

SUMMARY OF THE SUBJECT MATTER

According to the present subject matter, there is provided a system for storing and dispensing articles such as tissues, foodstuffs and the like. The system is in the form of a packet comprising a closure having a base portion and a flap portion which is at least in use pivotable with respect to the base portion about a pivoting axis; and a face with a flap area corresponding to the flap portion, terminating at two spaced apart points and having a majority thereof spaced from an imaginary line connecting the two points and corresponding to the pivoting axis; the closure being attached to the face at least at a part of the base portion and at a part of its flap area so that pivoting of the flap portion causes tearing of the face at the flap area to form a flap comprising the flap area of the face, and an outlet in the face corresponding thereto, allowing access to the interior of the packet; and to subsequently move between an open position in which the flap is raised relative to the outlet to provide the access, and closed position in which the flap covers the outlet.

The term weakening as used in the specification and claims denotes a weakening in the material formed using perforation, laser preparation e.g. thinning etc. or complete penetration of the material forming a slit or a complete cut.

The flap area of the face may be defined by a pre-formed packet weakening terminating at the two spaced apart points. The packet weakening may terminate with a stopper at each end, greater in width than the width of the packet weakening and smaller in width than the extension of the packet weakening.

The flap portion of the closure is defined by a pre-formed closure weakening in the closure terminating at terminating at the pivoting axis. Again, this may be created using perforation, laser preparation e.g. thinning etc. This closure weakening may be designed for tearing when the flap portion is pulled away from the packet face with a predetermined force.

The packet weakening and/or closure weakening as well as any pre-formed slits in the closure, may terminate with a stopper at each of its ends a slit or removal of material from the packet face, greater in width than that of the weakening or slit and smaller in width than the extension of the weakening or slit. The stopper may embody any number of shapes or patterns e.g. circular, zigzag or undulating.

The closure may be attached to the packet face with an adhesive, heat welding or another method of attachment. In production, a roll of closures may be sequentially attached to pre-filled packets Alternatively, the closures may be arranged within a dispenser or magazine etc.

The flap portion may have at least a majority of its area attached to the face of the packet so as to cover the packet weakening and the two points.

At least one of the face of the packet and the closure may be made of a material adapted for being cut to form, respectively, the flap area or the flap portion.

The closure may be shaped and located such that its base portion extends beyond the imaginary line in a direction away from the flap area, at least at the two points, to at least strengthen the flap at the two points. The closure may also be shaped and located such that at least one of either the base portion or its flap portion extends beyond the flap area in a direction away from the imaginary line, at the least improving sealing ability.

The closure may be manufactured from one piece of material having greater or less stiffness than that of the packet. The closure may be formed using injection molding, thermoforming, pressing, computer-cutting etc.

The closure may be formed with a locking tab having one end attached to the flap portion so it may pivot with respect thereto, and a second end engagable with the base portion when the flap is in the closed position. The locking tab may pivot with respect to the flap portion about a hinge axis spaced from the pivoting axis, between an initial closed position in which it is generally aligned with the base portion of the closure, an open position in which the tab projects from the base portion for holding by a user's fingers, and a final closed position in which it is brought into engagement with the base portion for the fixation of the flap in its the closed position.

The locking tab may include a locking tongue, formed by a slit or cutout in the locking tab. Correspondingly, the base portion of the closure may have at least one locking portion on its periphery, which is smaller in its length than the entire length of the periphery and free of attachment to the packet, being spaced from the face of the packet with a locking area, where the locking portion and the locking area of the face act as a receptacle for inserting the locking tongue to engage with the base portion of the closure. In the final closed position, the locking tab may be folded 180° from its initial closed position around the hinge line.

Alternatively, the closure may consist of a strip of an adhesive tape having at least a portion detachably attachable to the face of the packet, to maintain the packet flap in a closed position as required, effectively resealing the packet after initial tearing of the weakening.

It must be noted that the weakening and closure do not need to be centered on the packet face and may be positioned towards the edge of such a packet if so required According to another aspect of the present subject matter, there is provided closure for use in a packet the closure being manufactured from one piece of material and comprising a base portion with a locking portion; and a flap portion which at least in use is rotatable about an integrated pivoting axis between an initial closed position in which the flap portion is generally aligned with the base portion of the closure, an open position in which the flap portion is rotated around the pivoting axis relative to the base portion, and a final closed position in which the flap portion is again generally aligned with the base portion; and a locking tab having a first end attached to the flap portion and a second end which is free at least when the closure is in use, to allow the locking tab pivoting with respect to the flap portion around an integrated hinge line, between a free position in which the free end of the locking tab is spaced from the locking portion, and a locking position in which the locking tab is engageable with the locking portion at a location spaced from the first end.

The closure may constitute an integral part of the packet or may be configured for an application to the packet.

The locking tab may include a locking tongue, formed by a slit or cutout in the locking tab.

The base portion of the closure may have at least one locking portion on its periphery that is essentially smaller in its length than the entire length of the periphery and that is free of attachment to the packet, being spaced from the face of the packet at a locking area thereof, wherein the locking portion and the locking area of the face act as a receptacle for inserting the locking tongue in engagement with the locking portion of the base portion of the closure.

BRIEF DESCRIPTION OF THE DRAWINGS

In order to understand the subject matter and to see how it may be carried out in practice, embodiments will now be described, by way of non-limiting examples only, with reference to the accompanying drawings, in which:

FIG. 3A is a cross-sectional view of the closure shown in FIG. 2A, taken along a line A-A;

FIG. 3B shows detail B from FIG. 3A;

FIG. 3C shows detail C from FIG. 3A;

FIG. 4 is a bottom view of the closure shown in FIG. 1B, with shaded regions defining the area where the closure is unattached to the packet;

FIGS. 7A to 12C illustrate different configurations of closures according to the present subject matter;

DETAILED DESCRIPTION OF EMBODIMENTS

FIGS. 1 to 11 show different examples of a packet with a closure according to the present subject matter. In these examples, the packet is adapted for storage and dispensing of tissues, though it may of course be used for any other suitable applications including wet or dry foodstuffs, and is adapted for dispensing one tissue at a time. The function of the closure is to provide a method to repeatably seal the tissue outlet of the packet to avoid contamination and dehydration of the tissues contained therein.

Herein, any reference to "tissues" includes, in addition to regular tissues, also wet tissues, towelettes, napkins and all similar articles, whether dry or pre-moistened. Tissues may be arranged within the packet as separately connected sheets or interleaved discrete sheets, stacked to ensure that as the leading tissue is removed from the package a portion of the trailing tissue passes through the outlet and releases the leading tissue once in a position to allow its (the trailing tissue) easy removal when required (and in turn becoming the leading tissue). Tissues may also be stacked simply without interleaving so the removal of the top tissue has no bearing on the positioning of those below.

The packet may be made from any material or a number of materials including synthetic resins, plastics, laminated or unlaminated cardboard etc. and its shape may vary.

The location of the closure on the packet in the described examples is at the center of the packet's face though it may clearly be varied and does not have to be positioned as in customary applications on the market today.

Figure 1A:
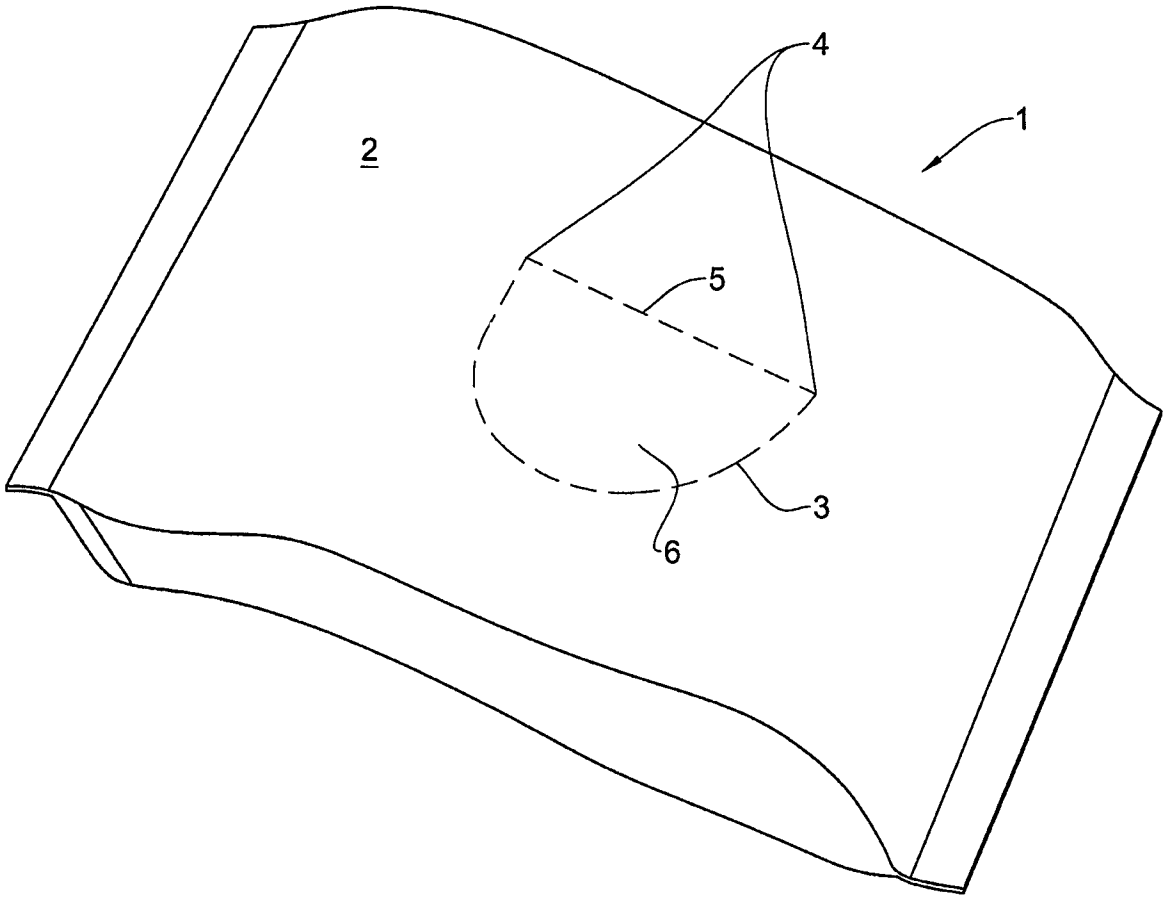
FIG. 1A illustrates a packet of the present subject matter.

With reference to FIG. 1A, a packet 1 is shown including a face 2 with a packet weakening 3 (shown in a short dashed line), defining the boundary of a tissue outlet to be formed when the weakening is torn, through which the tissues are to be removed from inside the packet 1.

The weakening terminates at two spaced apart points 4 connected by an imaginary line 5 (shown in a long dashed line). A majority of the weakening 3 is spaced from the imaginary line 5 connecting the two points 4 to define, together with the weakening 3 a flap area 6.

Figure 1B:
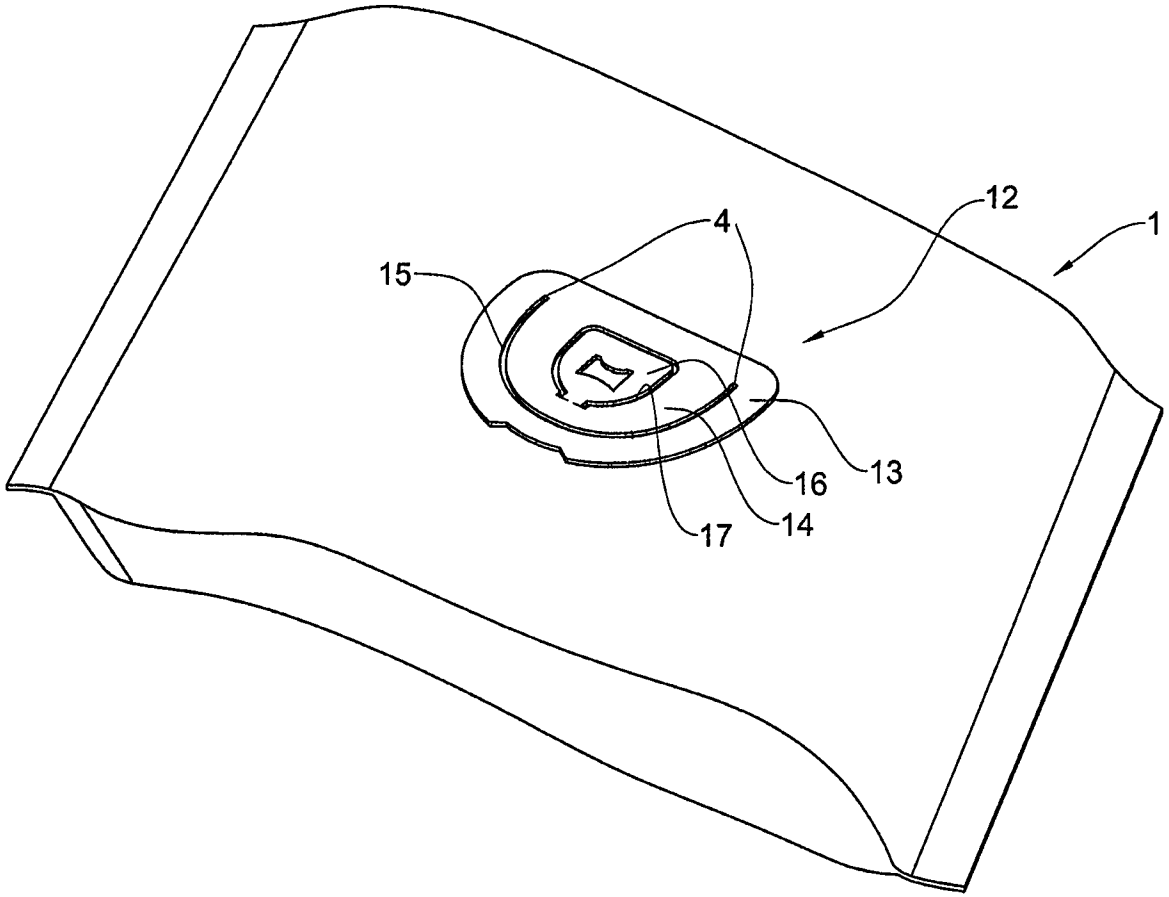
FIG. 1B illustrates the packet shown in FIG. 1A, with a closure in accordance with one embodiment of the present subject matter, attached to its face, when the closure is in its closed position.
Figure 1C:
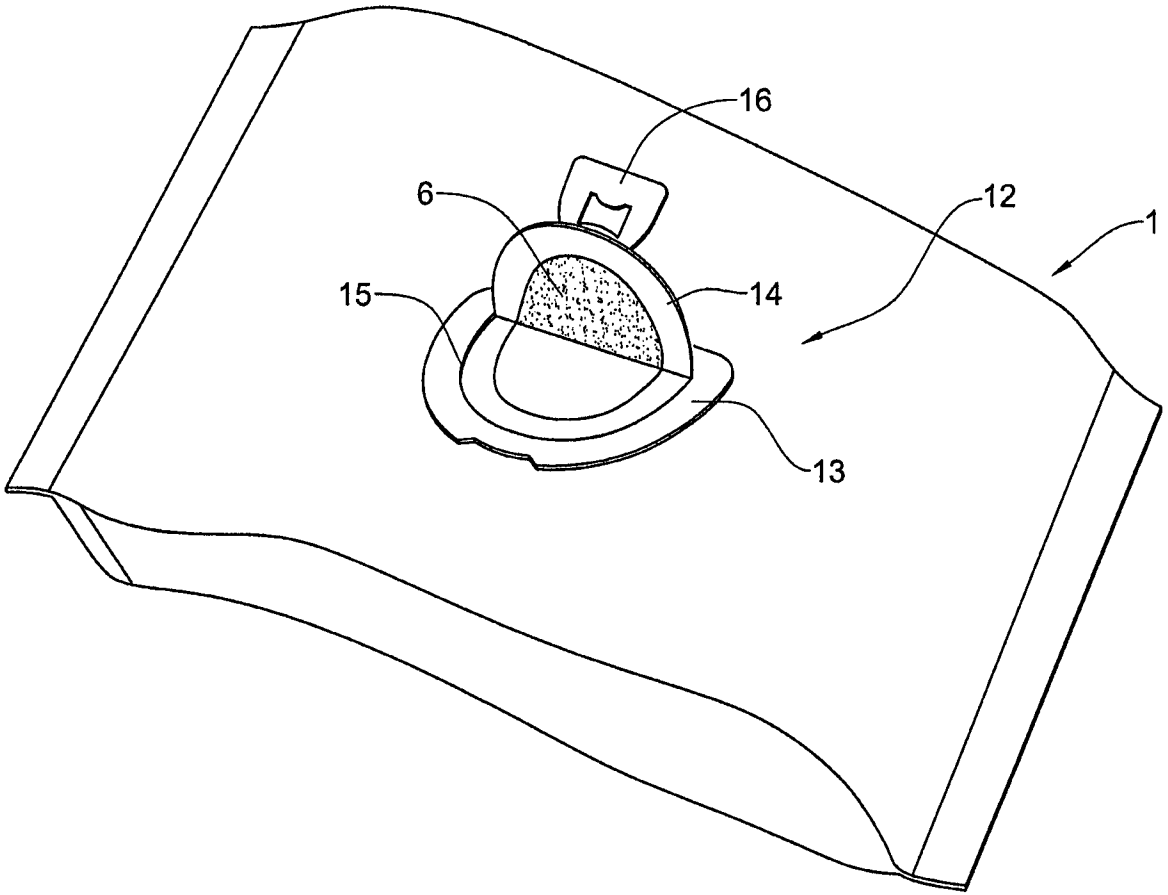
FIG. 1C illustrates the packet with the closure shown in FIGS. 1A and 1B, when the closure is in its open position.

FIGS. 1B and 1C illustrate a closure 12 comprising an outer ring constituting its base portion 13. The base portion 13 fully surrounds the flap portion 14 (although this isn't always the case, see FIG. 6), defined by a weakening 15 (in this embodiment a semi-circle shape) in the closure 12. The innermost section of the closure 12 is the locking tab 16. The locking tab 16 is defined by a pre-formed slit 17 in the flap portion 14. The closure 12 has a generally semi-circular shape, although it may embody a number of shapes, using the same locking principal to be explained in the description that follows. The closure 12 may be made from a variety of materials including a number of plastics, laminates and cardboards.

Figure 2A:
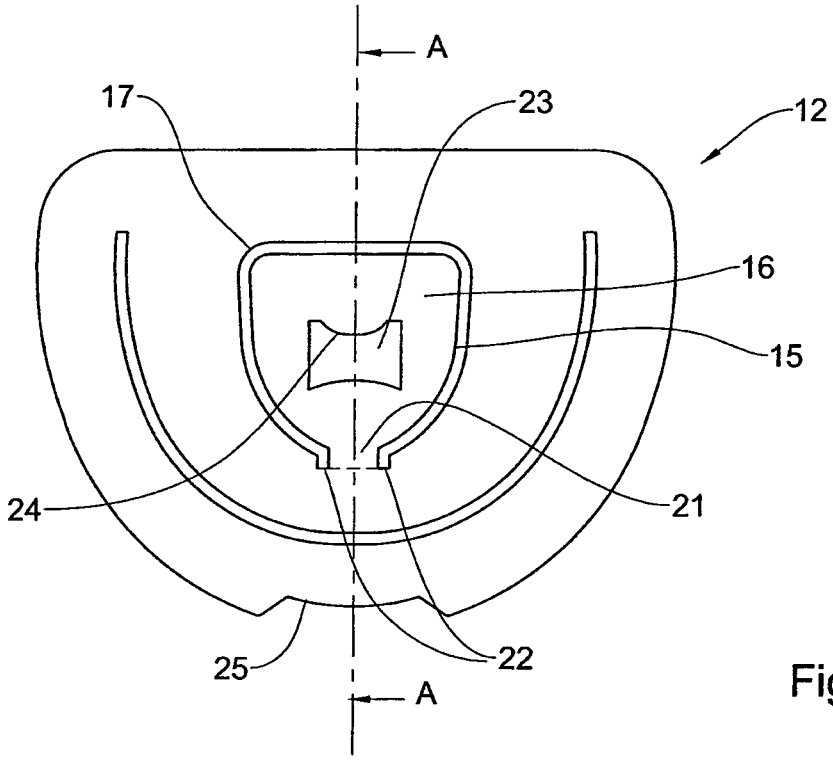
FIG. 2A is a planar top view of the closure illustrated in FIG. 1B.

FIG. 2A illustrates the same embodiment of the closure as FIG. 1B with a generally semi-circular shape. The locking tab 16 is pivoted around a hinge axis 21 between two small stoppers 22 in the closure 12 at both ends of the pre-formed slit 17 defining the locking tab 16. The stoppers 22 help to stop the slit 17 extending beyond its initial limits during repeated opening and closing of the locking tab 16. The locking tab 16 may encompass a cutout region 23, as in this embodiment, defining the locking tongue 24 or the locking tongue may be formed in the locking tab with a pre-formed slit. The locking tongue 24 is slipped under the locking portion 25, cut into the perimeter of the closure 12, to keep the tissue outlet (not pictured) sealed between uses.

Figure 2B:
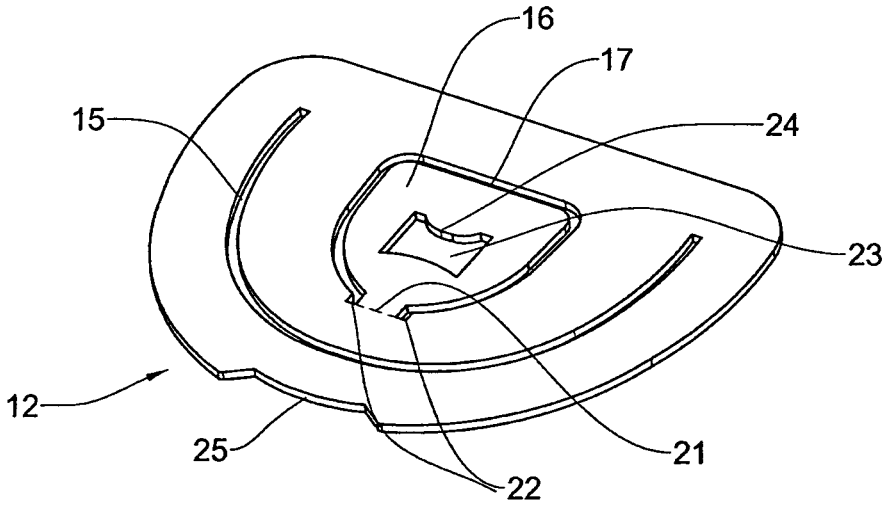
FIG. 2B is a top isometric view of the closure illustrated in FIG. 1B.

FIG. 2B is a top isometric view of the closure illustrated in FIG. 2A.

In FIG. 3A the general material thickness along cross section A-A (see FIG. 2A) of the closure 12 is defined. This cross section is generally the same for any shape closure of this style embodiment of the present subject matter, including the detail at the hinge axis 21 shown in FIG. 3B and closure weakening 15 shown in FIG. 3C.

Referring again to FIGS. 1B and 1C, the closure 12 is attached to the face 2 of the packet 1, e.g. by an adhesive or heat welding, so as to cover the flap area 6 including the weakening 3 and the two points 4. In particular, the flap portion 14 covers the flap area 6 and, once attached, the flap portion 14 and the flap area 6 combine to form an integrated flap, as shown in FIG. 1C. The base portion 13 always remains in a fixed position relative to the packet face 2 i.e. while the closure in its initial closed position, while the closure is in its open position, and after the closure is its final closed position.

FIG. 4 illustrates, again using the first embodiment, the region 41 on the underside of the closure 12 where it is permanently attached to the packet (not pictured). Equivalent regions on any shaped closure are also attached to the packet. In this embodiment, the base portion 13 is entirely attached to the packet except for a portion on the periphery in the region of the locking portion 25. Optionally, a region 31 around the closure weakening 15 is also left unattached. The remainder of the flap portion 14 is attached to the flap area (not shown) maintaining the integrated flap. The locking tab 16 is also unattached and remains free to pivot around the hinge axis 21.

Figure 5A:
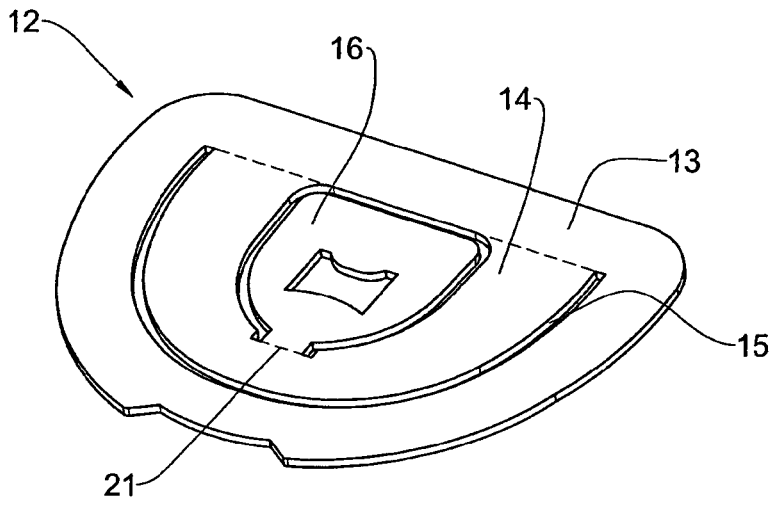
FIGS. 5A, 5B and 5C illustrate the closure shown in FIGS. 2A and 2B, with the closure's locking tab in its initial closed position (FIG. 5A); open position (FIG. 5B); and final closed position (FIG. 5C)
Figure 5B:
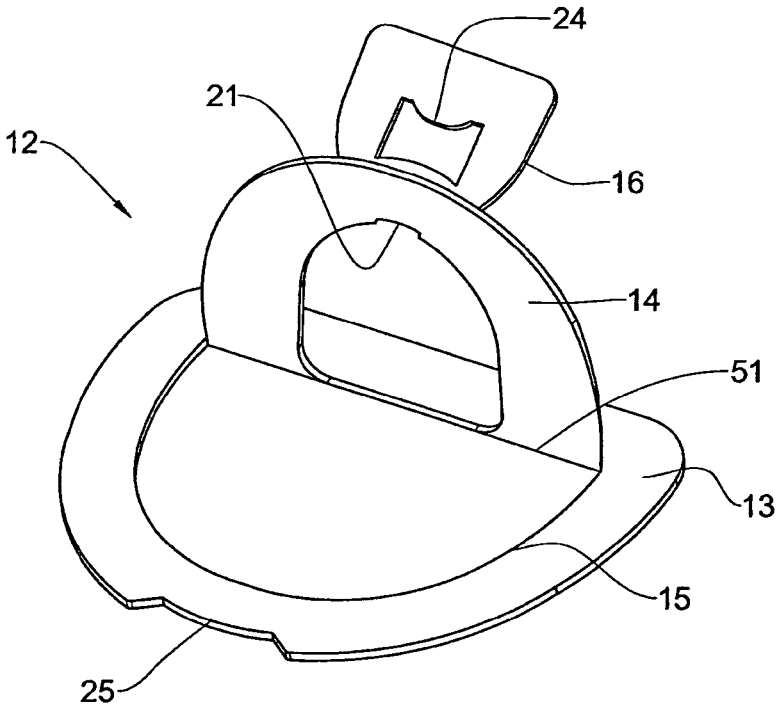
Figure 5C:
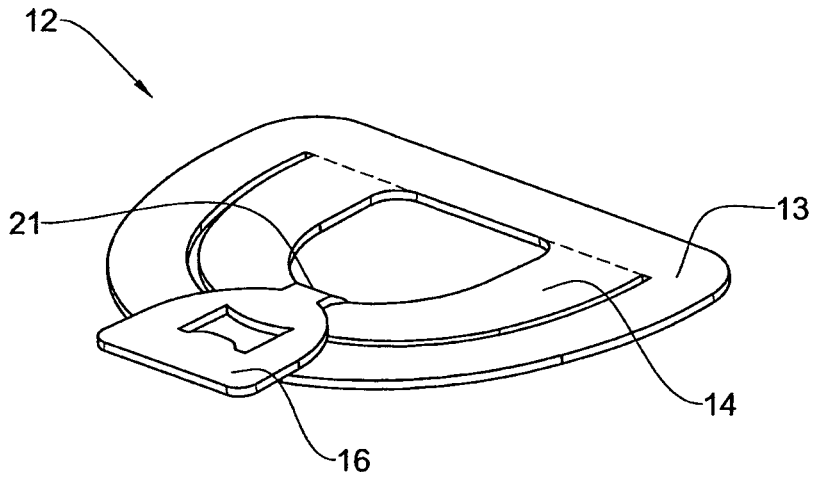

The manner of operation is illustrated in FIGS. 5A, 5B and 5C. The closure 12 is able to repeatably and sealably close the tissue outlet.

In FIG. 5A this embodiment of the closure 12 is in its initial closed position, as the consumer would receive the tissue dispenser. The flap portion 14 lays flat, in the same plane as the base portion 13 and packet face (not shown). The closure weakening 15 is not torn. The locking tab 16 also lies in the same plane. When the consumer pulls on the locking tab 16 the closure weakening 15 and packet weakening (as shown in FIG. 1C) tear and the flap portion 14 is raised, as seen in FIG. 5B where the closure is in the open position.

In FIG. 5B the locking tongue 24 and locking portion 25 in the periphery of the closure 12 can be seen. In the open position they are not engaged. The locking tab 16 is pivoted to some degree around the hinge axis 21. The closure weakening 15 (FIG. 5B) has been torn upon initial opening and the flap portion 14 is formed and rotated around a pivoting axis 51 and is no longer in the same plane as the base portion 13.

FIG. 5C shows this embodiment of the present subject matter in the final closed position, after the initial opening and reclosure. The flap portion 14 is in the same plane as the base portion 13, flat against the packet face (not shown), and the locking tab 16 has been fully rotated 180° around the hinge axis 21. In the final closed position the locking tongue is positioned under the locking portion locating the flap (incorporating the flap portion 14) in the closed position, thus protecting the contents of the packet from the outside environment.

Figure 6:
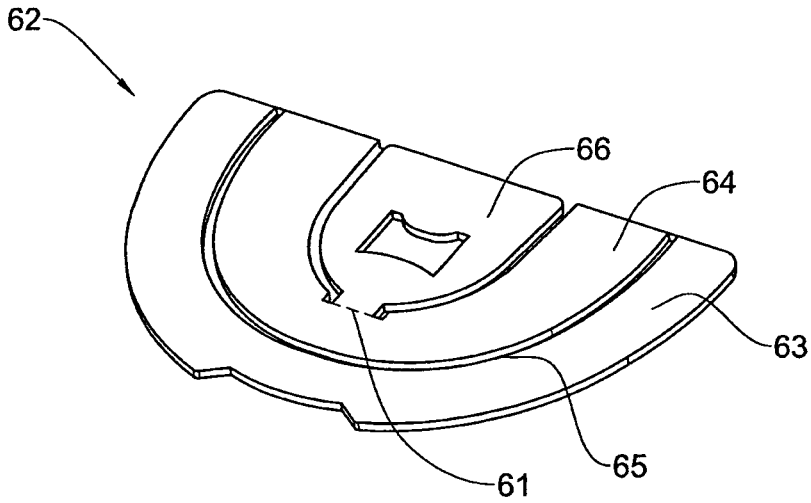
FIG. 6 illustrates a variation of the embodiment of the closure seen in FIGS. 1B to 5B.

FIG. 6 shows a variation of the embodiment of the closure seen in FIGS. 1B to 5B. In this design the base portion 63 does not fully surround the flap portion 64 of the closure 62. The base portion 63 surrounds the flap portion 64 in the region of the closure weakening 65. The locking tab 66 is much the same as that seen in FIGS. 1A to 5C although not fully surrounded by the flap portion 64 as in the previous embodiment. It is only connected to the flap portion 64 in the region of the integral hinge 61.

Figure 7A:
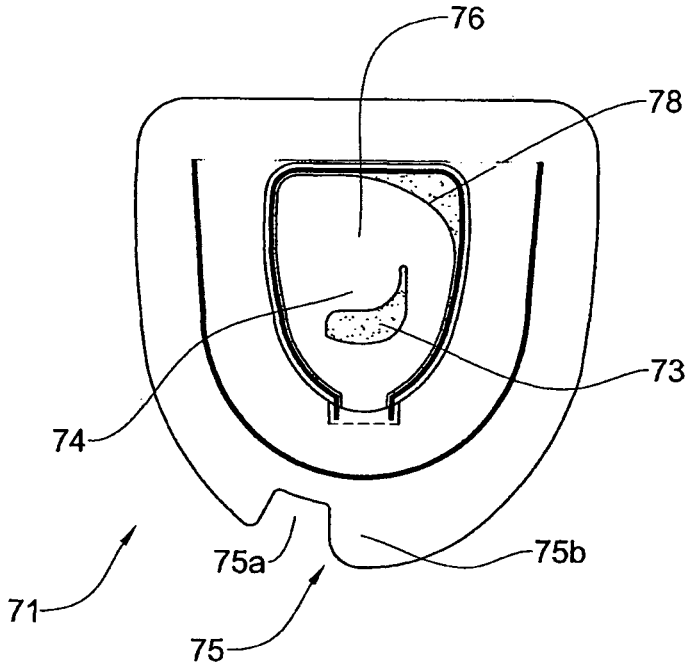
Figure 7B:
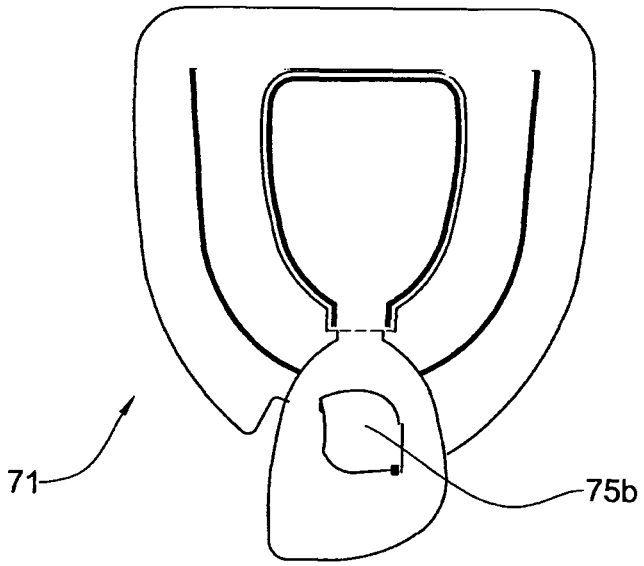

FIGS. 7A and 7B show another variation of the embodiment of the closure seen in FIGS. 1B to 5B. A closure 71 is of a structure similar to the structure of the closure 12, with the differences being in the shape of its locking tab 76, its cut-out region 73 defining a locking tongue 74, and its locking portion. 75.

The locking tab 76 has a grasping cut-out region 78 for facilitating the grasping of the locking tab 76, having an arc shape. The locking portion 75 comprises a cut-out region 75*a* forming an engaging part 75*b*, so that the cut-out region 75*a* provides the locking tongue 74 with an access to its locking position under the engaging part 75*b*, as shown in FIG. 7B.

Figure 7C:
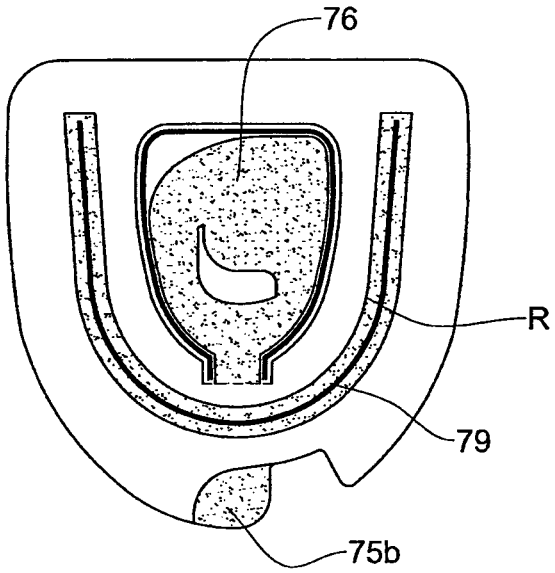
Figure 7D:
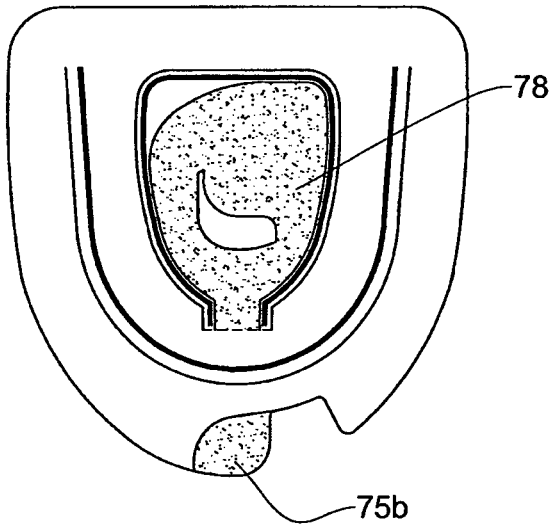

With reference to FIGS. 7C and 7D, there are schematically shown regions of the closure illustrated in FIGS. 7A and 7B, that are permanently attached to the packet (not shown) and those that are left unattached. As shown in FIG. 7C, the regions that are left unattached are the locking tab 76, a region R extending along the closure weakening 79 and the engaging part 75*b* of the locking portion 75, while the rest of the closure 71 is attached to the packet. Alternatively, as shown in FIG. 7D, the region R is attached to the packet, leaving only the locking tab 76 and the engaging part 75*b* unattached.

Figure 8B:
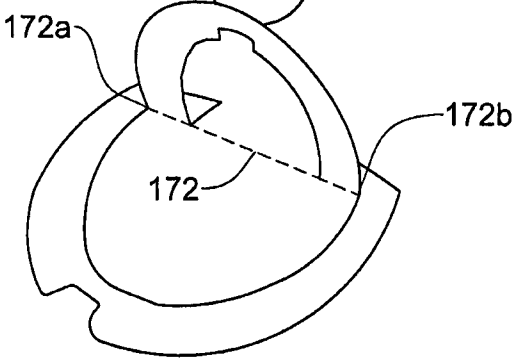
Figure 8A:
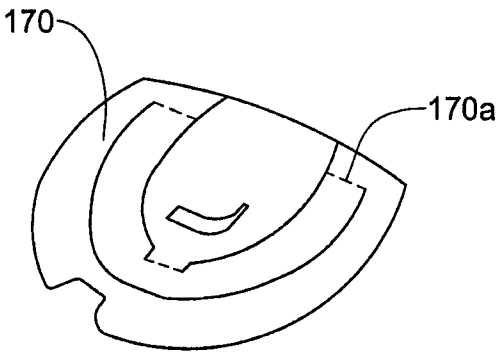
Figure 8C:
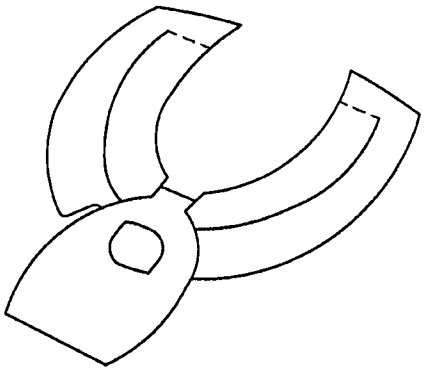

With reference to FIGS. 8A to 8C, there is shown another configuration of the closure shown in FIGS. 7A to 7D, where a distal part 170*a* of a base portion 170 does not extend along the entire pivoting axis 172 (shown in a dotted line in FIG. 8B), but terminates in the proximity of two ends 172*a* and 172*b* thereof.

Figure 9A:
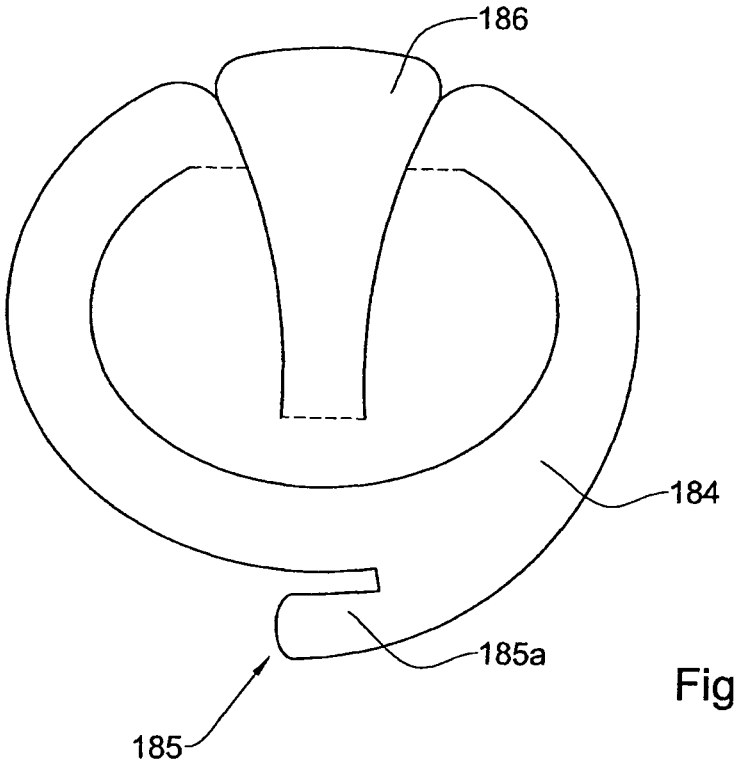
Figure 9B:
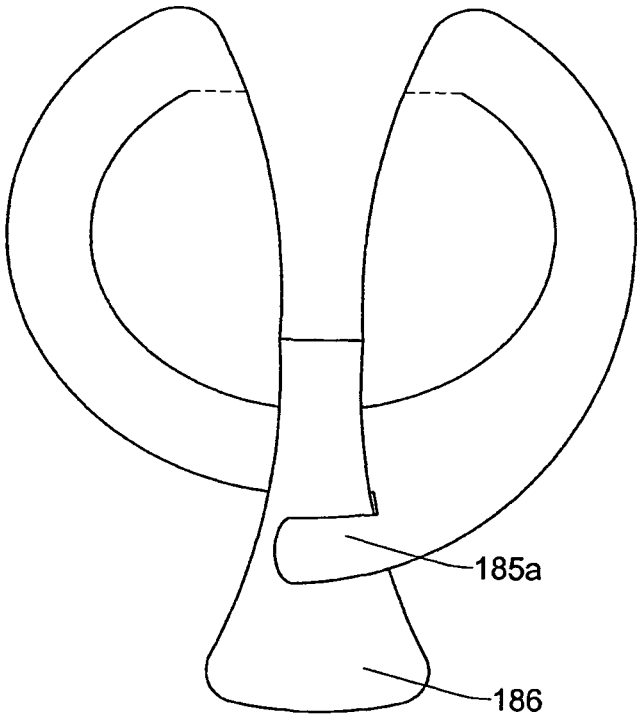

With reference to FIGS. 9A and 9B, there is shown another configuration of the closure shown in FIGS. 8A to 8C, wherein a locking tab 186 has no locking tongue, so that the engagement of the locking tab 186 to a locking portion 185 of the base portion 184 is performed merely by inserting the locking tab 186 under the engaging part 185*a* of the locking portion 185.

Figure 10:
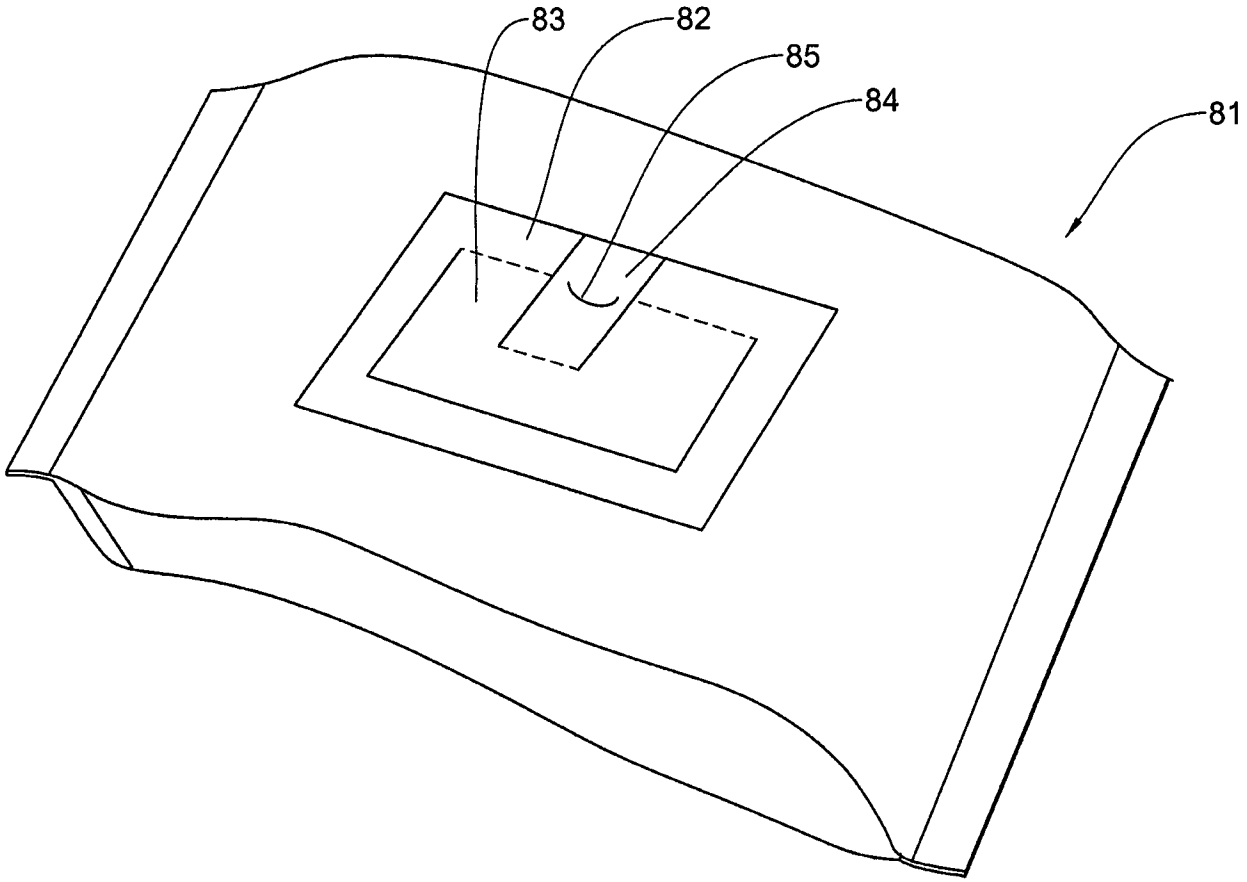

FIG. 10 shows another configuration of the present subject matter, with a closure 81 of a generally rectangular shape. The main features of the base portion 82, flap portion 83 and locking tab 84 remain in this embodiment. A pre-formed slit 85 in the locking tab 84 defines the locking tongue although a cutout as in the previous embodiment could also be used. In this case a cutout in the periphery of the base portion 82 is not required to act as a locking portion, as the straight edge (of the base portion 82) is a sufficient receptacle for the locking tongue 85.

Figures 11A, 11B, 11C:
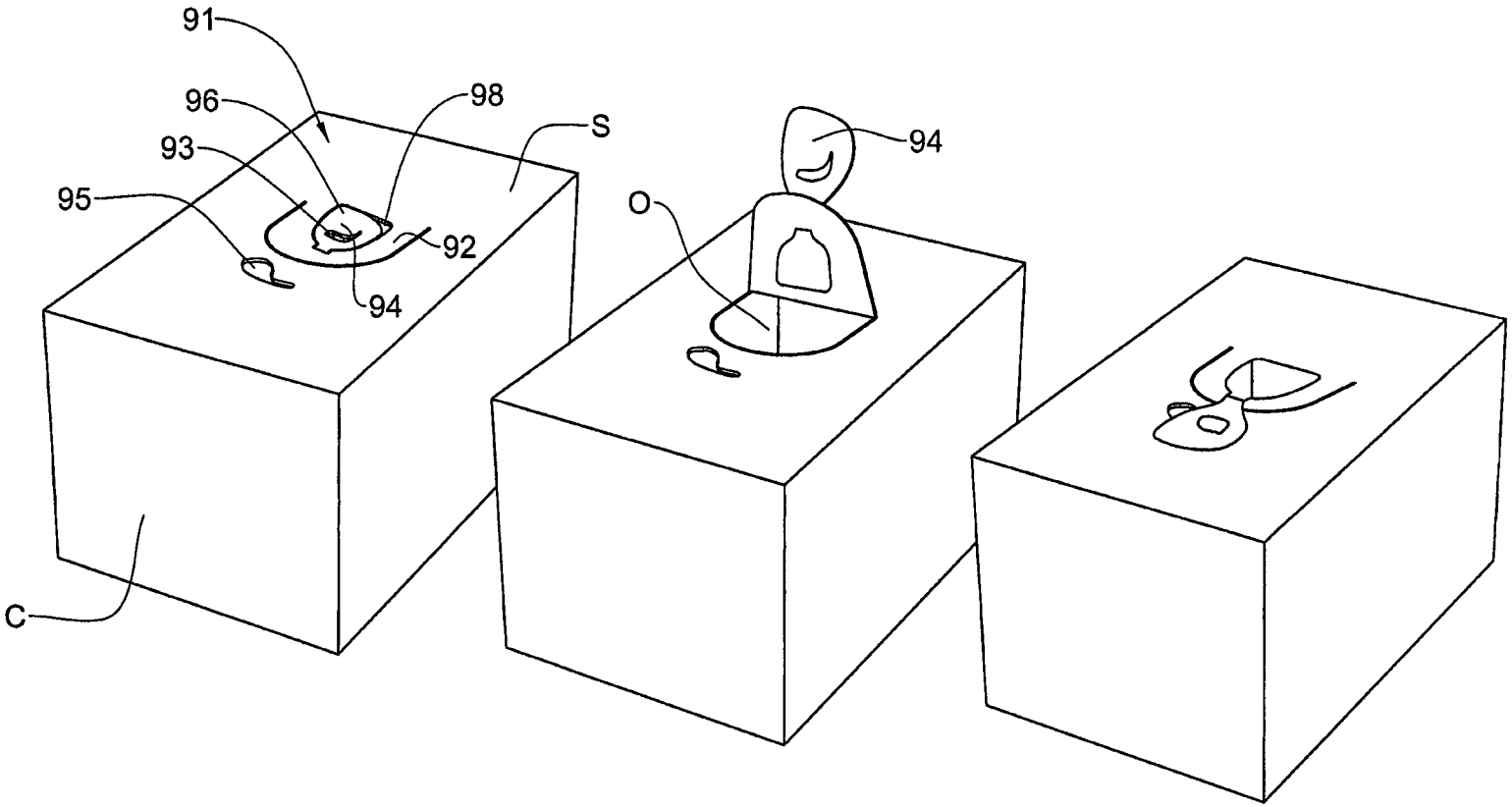

FIGS. 11A to 11C show another configuration of the present subject matter, with a closure 91 constituting an integral part of a container C, which comprises a surface S, in which the closure 91 is formed. The closure 91 has a structure similar to that of the closure 71 shown in FIGS. 7A and 7B, although it can have other structure according to the present subject matter, comprising a flap portion 92, a locking tab 96 with a grasping cut-out region 98 and a cut-out region 93 defining a locking tongue 94, and a locking portion 95. However, the closure 91 has no base portion other than the surface S, which is not required in this configuration as no attachment of the closure to the surface is needed The flap portion 94 defines an outlet O exposed when the closure 91 is in its open position (FIG. 11B), through which the contents of the container C can be taken out by a consumer.

Figures 12A, 12B, 12C:
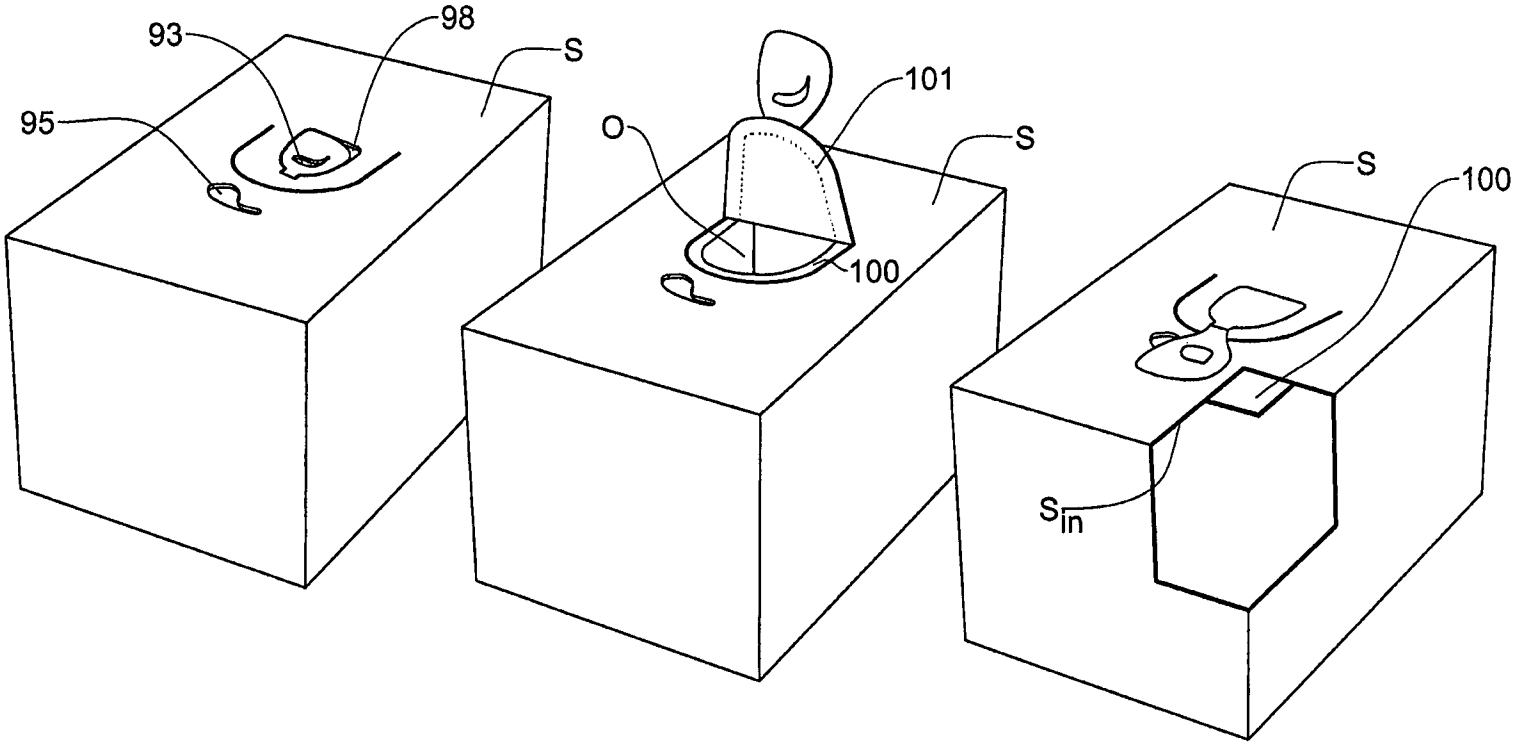

The grasping cut-out region 98, the cut-out region 93 and the locking portion 95 can be either removed from the surface S during the manufacture of the container C or formed as a weakening along the boundaries of the regions 98, 93 and 95, to be torn by a consumer, when the container is first used. In case that these regions are removed during the manufacture, and therefore are left exposed, the container C can be wrapped by a transparent material to prevent the exposure of the contents thereof. Alternatively, as shown in FIGS. 12A to 12C, the container C can be provided with a covering sheet 100, attached to an inner face $S_{in}$ of the surface S and sized so as to cover at least the removed regions, namely, the grasping cut-out region 98, the cut-out region 93 and the locking portion 95 (FIG. 12A). The sheet 100 is formed with a weakening corresponding to a line 101 (shown in dashed line in FIG. 12B), along which the sheet is torn, thereby forming an outlet O (FIG. 12B) in the surface S.

The closure according to the present subject matter can be attached directly to a packet, such as for examples the closures 12 shown in FIG. 1B, or indirectly, i.e. attached to any additional element which may not constitute an integral part of the packet, or may be made of a material different from that of the packet, as long as the closure attached to such an element provides an access to the contents of the packet. The additional element may further constitute a part of the closure, i.e. configured to be attached to the packet together with the closure.

Figure 13B:
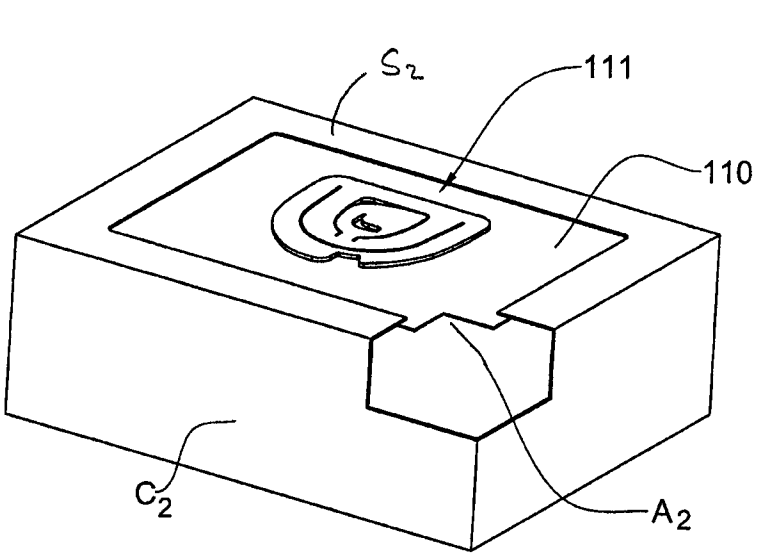
FIGS. 13A and 13B illustrate another example of the using of the closure shown in FIGS. 7A and 7B.
Figure 13A:
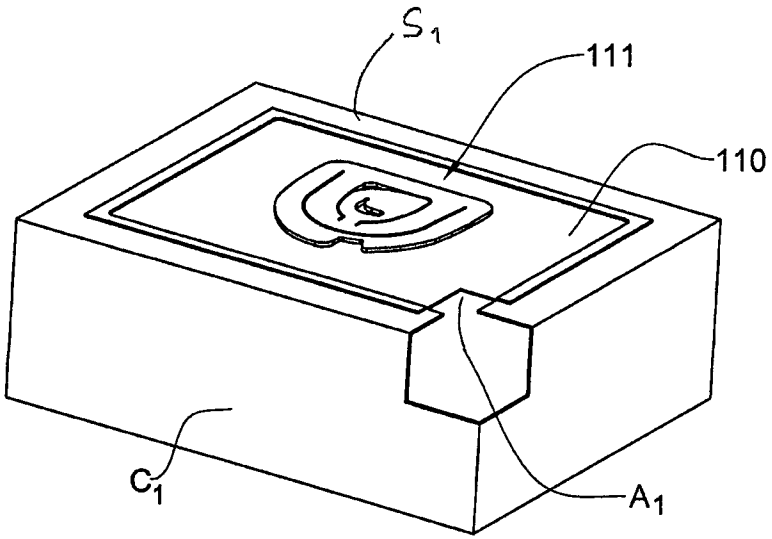

FIGS. 13A and 13B show closures 111 similar to the closure 71 (although any other described above can be used as well) attached to a sheet 110, which constitutes a part of one of the surfaces of a container $C_1$ or $C_2$.

As shown in FIG. 13A, the sheet 110 is attached to an outer face of a surface $S_1$ of the container $C_1$, covering an aperture $A_1$ within the surface $S_1$. The aperture $A_1$ has to be made before the attachment of the sheet 110, as there will be no access to the aperture $A_1$ after the sheet 110 is attached.

As shown in FIG. 13B, the sheet 110 is attached to an inner face of the surface $S_2$ of the container $C_2$ covering an aperture $A_2$. The aperture $A_2$ may be made before the attachment of the sheet 110 or formed by removing a part of the surface $S_2$ when the container is first used. In the latter case, the aperture $A_2$ will be defined by a weakening (not shown) formed within the surface $S_2$, allowing its removal by a consumer.

The closure according to the present subject matter may further comprise hanging means made of a material different from that of the closure, or the same material as the closure and constituting an integral part thereof or attached thereto. The hanging means may be associated with any part of the closure, depending on the location of the closure and the orientation thereof with respect to the packet.

Figure 14B:
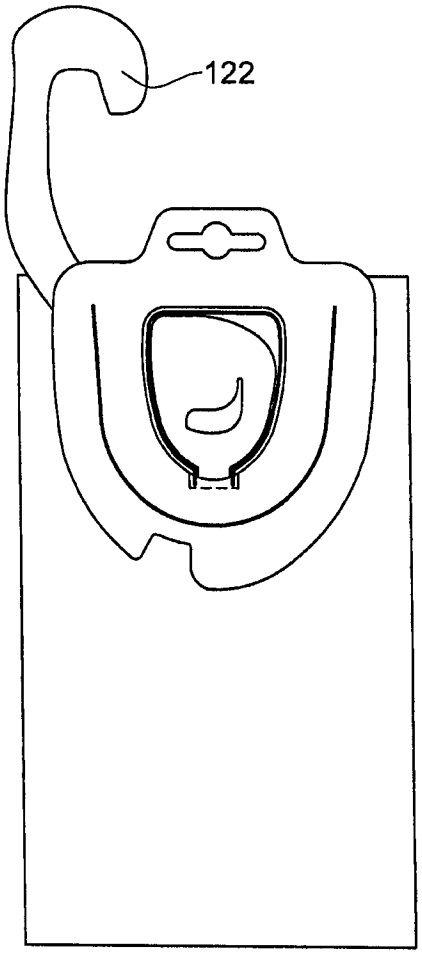
FIGS. 14A to 15B illustrate modifications of the closure shown in FIGS. 7A and 7B.
Figure 14A:
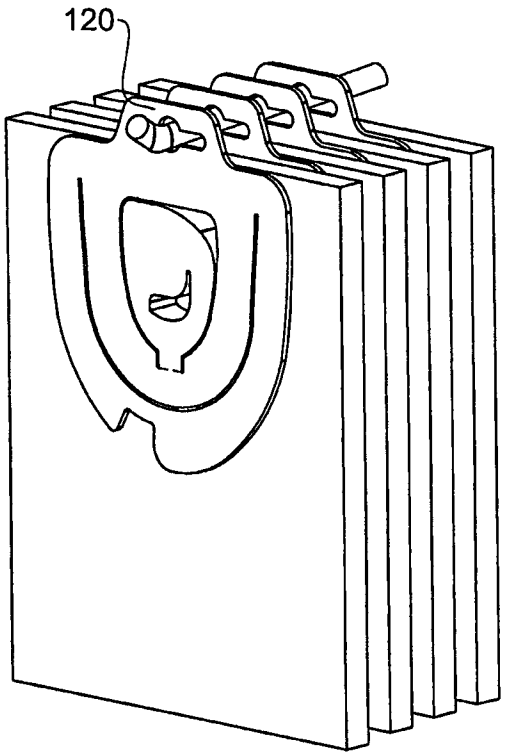

The hanging means may be shaped for example as a hanging loop 120, as shown in FIG. 14A and/or a hanging hook 122, as shown in FIG. 14B, and may be useful, for example, when the packet is at home or exhibited for sale.

The closure according to the present subject matter may further comprise cutting means optionally made of the same material as the closure and detachably attached thereto allowing the consumer to easily separate the cutting means from the closure. The cutting means can be configured for creating a cut along a boundary of a portion of the closure and, optionally, a corresponding boundary of the packet. This configuration allows the packet to be completely sealed along the weakening of the packet and the closure of the before it is used.

Figure 15B:
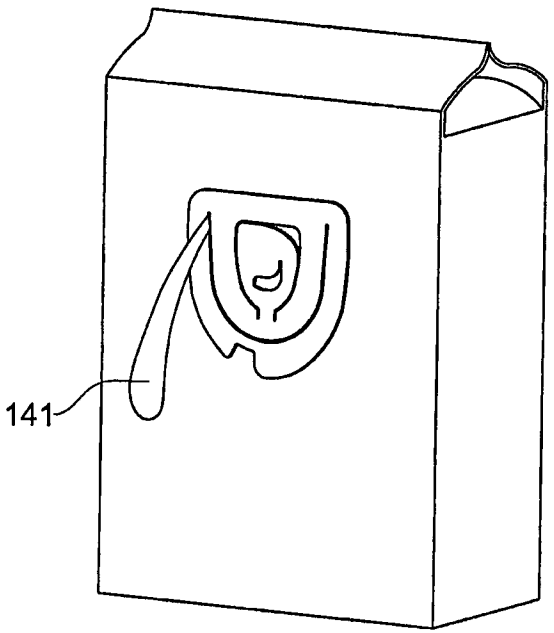
Figure 15A:
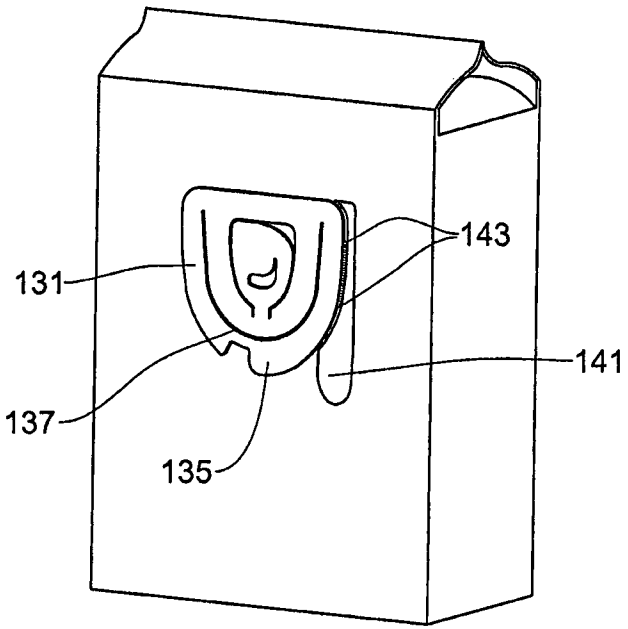

With reference to FIGS. 15A and 15B, a closure 131, which may be any closure according to the present subject matter, comprises a knife 141 detachably attached to a base portion 135 of the closure by picks 143 along an attachment line forming an attachment line, allowing a consumer to separate the knife 141 from the base portion 135 by pivoting the knife 141 about the attachment line 143 and by pulling it away therefrom. The knife 141 is configured to create a cut along a closure weakening 137 and a corresponding packet weakening defining an opening (not seen), allowing an access to the interior of the packet.

As previously mentioned above, the package may be utilized for storage and dispensing of a variety of products such as foodstuff (e.g. dried food in loose form, etc.). Likewise, the package may be designed in many different shapes, and the location of the dispensing closure may be selected as desired depending among others on its contents. For example, in case of a package intended for dried food stuff, it may be desired that the package be a self standing type and that the dispensing opening be fitted at or near an upper-most end thereof. However, there is no limitation regarding the shape and features of the package as it may be also a soft pack.

It is further appreciated that the subject matter is concerned with a dispensing closure as illustrated and discussed herein above, which may be manufactured separately from the package and applied to the package at any stage. It will be appreciated by a person skilled in the art that the present subject matter is not limited by what has been shown by the exemplary embodiments described hereinabove. Thus, the packet with a closure unit for its outlet can be embodied in a variety of configurations within the scope of the subject matter, mutatis mutandis.

The invention claimed is:

1. A packet, comprising:

a closure having a base portion and a flap portion which is at least in use pivotable with respect to the base portion about a pivoting axis; and a face with a flap area corresponding to the flap portion, terminating at two spaced apart points and having a majority thereof spaced from an imaginary line connecting the two spaced apart points and corresponding to the pivoting axis;

the closure being attached to the face at least at a part of the base portion and at a part of its flap area so that pivoting of the flap portion causes tearing of the face at the flap area to form a flap comprising the flap area of the face, and an outlet in the face corresponding thereto, allowing access to the interior of the packet; and to subsequently move between an open position in which the flap is raised relative to the outlet to provide the access, and closed position in which the flap covers the outlet, wherein the closure is formed with a locking tab, created by a pre-formed slit in the flap portion, having at least one end attached to the flap portion so as to be pivotable with respect thereto, and a second end engageable with the base portion when the flap is in the closed position.

2. The packet according to claim 1, wherein the flap area of the face is defined by a pre-formed packet weakening terminating at the two spaced apart points.

3. The packet according to claim 2, wherein the pre-formed packet weakening is defined by a width dimension and terminates with a stopper at each end, greater in width than the width dimension of the packet weakening and smaller in width than the extension of the packet weakening.

4. The packet according to claim 1, wherein the flap portion of the closure is defined by a pre-formed closure weakening in the closure terminating at the pivoting axis.

5. The packet according to claim 4, wherein the closure weakening terminates with a stopper at each end, greater in width than the width of the weakening and smaller in width than the extension of the weakening.

6. The packet according to claim 1, wherein the flap portion has at least a majority of its area attached to the face of the packet so as to cover the packet weakening and the two spaced apart points.

7. The packet according to claim 1, wherein at least one of the face of the packet and the closure is made of a material configured for being cut to form, respectively, the flap area or the flap portion.

8. The packet according to claim 1, wherein the closure is shaped and located such that its base portion extends beyond the imaginary line in a direction away from the flap area, at least at the two spaced apart points, to at least strengthen the flap at the two spaced apart points.

9. The packet according to claim 1, wherein the closure is shaped and located such that at least one of its base portion and its flap portion extends beyond the flap area in a direction away from the imaginary line to at least improve sealing ability.

10. The packet according to claim 1, wherein the locking tab is pivotable with respect to the flap portion about a hinge axis spaced from the pivoting axis, between an initial closed position in which it is generally aligned with the base portion of the closure, a further open position in which the tab projects from the base portion for holding by a user's fingers, and a final closed position in which it is brought into engagement with the base portion for the fixation of the flap in the closed position.

11. The packet according to claim 10, wherein the locking tab comprises a locking tongue, formed by a slit or cutout in the locking tab.

12. The packet according to claim 11, wherein the base portion of the closure has a locking portion on its periphery that is essentially smaller in its length than the entire length of the periphery and that is free of attachment to the packet, being spaced from the face of the packet at a locking area thereof, wherein the locking portion and the locking area of the face act as a receptacle for inserting the locking tongue in engagement with the locking portion of the base portion of the closure.

13. The packet according to claim 11, wherein at least one of the locking tab or the locking tongue, created by the pre-formed slits, terminates with a stopper at each end, greater in width than the width of the pre-formed slit and smaller in width than the extension of the pre-formed slit.

14. The packet according to claim 10, wherein, in the final closed position, the locking tab is folded 180° from its initial closed position around the hinge axis.

* * * * *